United States Patent [19]

Hartmann et al.

[11] Patent Number: 4,978,865

[45] Date of Patent: Dec. 18, 1990

[54] CIRCUIT FOR REGULATING A PULSATING CURRENT

[75] Inventors: Ralf Hartmann, Kelkheim; Jürgen Reus, Freigericht, both of Fed. Rep. of Germany

[73] Assignee: VDO Adolf Schindling AG, Frankfurt am Main, Fed. Rep. of Germany

[21] Appl. No.: 341,147

[22] Filed: Apr. 20, 1989

[30] Foreign Application Priority Data

Jul. 20, 1988 [DE] Fed. Rep. of Germany ..... 3824526

[51] Int. Cl.[5] ..... H01H 47/32

[52] U.S. Cl. ..... 307/140; 307/10.1; 361/152; 361/154; 123/490; 318/599

[58] Field of Search ..... 307/105–109, 307/140, 10.1; 361/152–156; 123/478–490; 318/599, 138, 254

[56] References Cited

U.S. PATENT DOCUMENTS 4,446,410 5/1984 Yagura et al. ..... 361/152 X
4,452,210 6/1984 Sasayama et al. ..... 361/154 X
4,492,913 1/1985 Arnold et al. ..... 123/490 X
4,556,926 12/1985 Yanagida ..... 361/154
4,706,619 11/1987 Buchl ..... 123/490 X
4,823,825 4/1989 Buchl ..... 361/152 X
4,825,333 4/1989 Clive et al. ..... 361/154

FOREIGN PATENT DOCUMENTS 0151261 11/1981 Japan ..... 123/490

*Primary Examiner*—William M. Shoop, Jr.
*Assistant Examiner*—Paul Ip
*Attorney, Agent, or Firm*—Martin A. Farber

[57] ABSTRACT

In a circuit for controlling a pulsating current through an inductor, particularly the coil of an electromagnetic valve, the inductor is connected in series with a semiconductor switch and in parallel with a free-running diode. Furthermore a desired-value voltage is fed to a controller the output of which is connected via a pulse-width modulator to a control input of the semiconductor switch. A current flows through the inductor and the semiconductor switch, during a state of conduction of the semiconductor switch, to be measured. The current measurement is gated, in response to pulse-width modulation at the controller, and is then integrated for improved measurement of the current.

4 Claims, 2 Drawing Sheets

CIRCUIT FOR REGULATING A PULSATING CURRENT

FIELD AND BACKGROUND OF THE INVENTION

The present invention relates to an electric circuit for regulating a pulsating current by an inductor, in particular the coil of an electromagnetic valve, the inductance being connected in series with a semiconductor switch in parallel to a free-running diode, and a desired-value voltage being further adapted to be fed to a controller the output of which is connected via a pulse-width modulator to a control input of the semiconductor switch. By way of example, the circuit is particularly useful in the operation of an electromagnetic valve of a fuel-injection system for an internal combustion engine.

For regulating a pulsating current by an inductor, as accurate as possible a detection of the current is necessary. In the known circuits a current flows through a semiconductor switch and the inductor in a first part of a period of pulsation of the current. The semiconductor switch is nonconductive in a second part of the period. The magnetic energy stored in the inductor, however, produces a further flow of current through a so-called "free-running circuit" which consists of the inductor and a parallel-connected free-running diode. An exact measurement of the total current can actually be effected only in the feed lines of the inductance, which, however, is frequently not possible based on considerations of circuit construction technique.

SUMMARY OF THE INVENTION

It is an object of the present invention to provide an electric circuit for regulating a pulsating current through an inductor in which it is possible to determine the amount of the coil current during the entire period including the time interval of current flow during which the current flows through the semiconductor switch.

According to the invention, the current which is flowing through the inductor and the semiconductor switch, during a state of conduction of the semiconductor switch, is to be measured. The measurement is accomplished by gating the current in a specific time interval followed by integration of the gated current measure.

Another feature of the invention is that an actual-value voltage can be derived by means of a current voltage transformer (3) which is connected in series with the inductor (1) and the semiconductor switch (2), a further switch (9) which can be controlled by the pulse-width modulator (8), and an integrator (10).

According to a further feature, an output of the current/voltage transformer (3) is connected, via the further switch (9) to an input of the integrator (10).

Still further according to features of the invention, the further switch and the integrator are formed of a switchable operational amplifier (17) whose output is connected, via a capacitor (21) of fixed potential and a transistor (23) connected as impedance transformer as well as a voltage divider (24, 25), to the inverting input, and wherein the output voltage of the current/voltage transformer (11) is fed to the non-inverting input thereof.

Another feature of the invention is that the time constant of the integration circuit is substantially greater than the period of the signal given off by the pulse-width modulator.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

In the figures, identical parts are provided with the same reference numbers.

Figure 1:
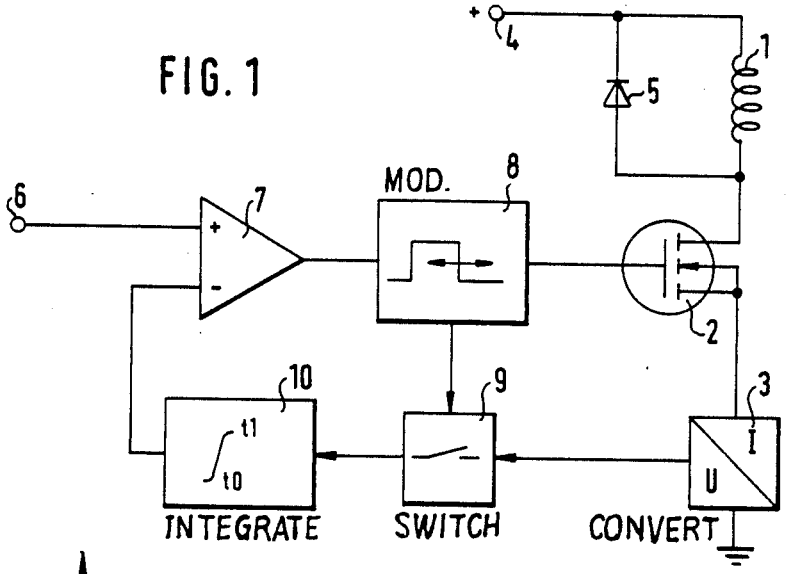
FIG. 1 is a block diagram of a first embodiment.

In the electric circuit shown in FIG. 1, an inductor or coil 1 is connected in series with a transistor 2 and a current/ voltage transformer 3 between the positive terminal 4 of a source of operating voltage, not shown in detail, and ground potential. In one preferred field of use of the circuit of the invention, the coil 1 is part of an electromagnetic valve, particularly a valve for the injection of fuel in an internal combustion engine. A free-running diode 5 is connected in parallel to the coil 1 in known manner.

A voltage V desired is fed as desired value to a controller 7 via an input 6. The output of the controller 7 is connected to the input of a pulse-width modulator 8 the output of which is connected to the control electrode of the transistor 2. The output signal of the modulator 8 is a periodic signal of pulses wherein the pulse width is variable. Furthermore, the pulse-width modulator 8 controls a switch 9 which can be formed, for instance, by a fieldeffect transistor.

The current/voltage (I/U) converter, or transformer 3, consists in its simplest form of a resistor over which there is a voltage drop which is proportional to the current. This voltage is fed, via the switch 9, to an integrator 10 the output of which is connected to the inverting input of the controller 7. As integrator 10, various known circuits can be employed, for instance a so-called "Miller integrator". The integration time constant is substantially greater than the period of the signal given off by the pulse-width modulator. For the sake of simplicity, the controller 7 has been shown as a difference amplifier having inverting and non-inverting input terminals. However, other types of controllers, such as proportional-plus-integral controllers, can be used in the invention.

Figure 2A:
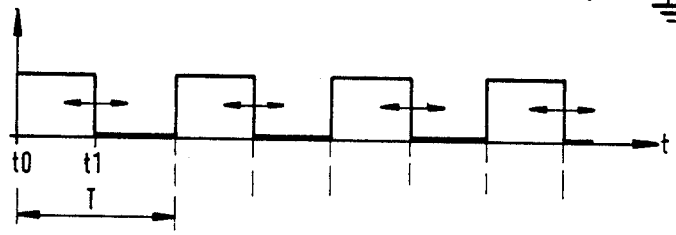
FIGS. 2*a*–2*c* are time diagrams of voltages and currents occurring with the circuit of the invention.
Figure 2B:
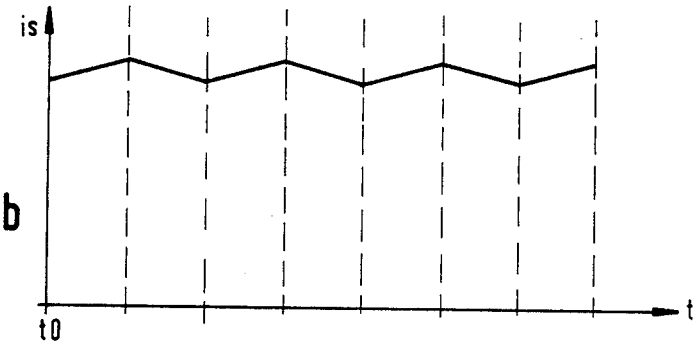
Figure 2C:
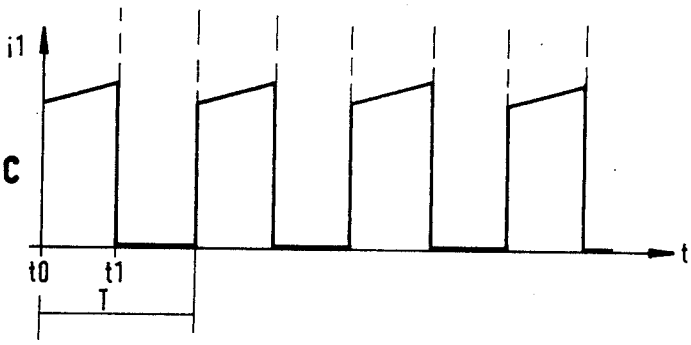

In FIGS. 2*a*, 2*b* and 2*c*, the horizontal axis of each graph represents time, and the vertical axis represents voltage. FIG. 2*a* shows the variation of the output voltage of the pulse-width modulator, the lateral displacement of the rear flank, which is dependent on the output voltage of the controller, being indicated by a double arrow. During the time t0 to t1, the transistor 2 is conductive. During the rest of the period T the transistor 2 is blocked. The current is through coil 1, shown in FIG. 2*b*, rises accordingly during the time t0 to t1 and then drops until the transistor 2 is again connected. A current i1 therefore flows through the transistor 2 during the time t0 to t1. A current i2 flows through the free-running diode 5 during the time t1 to the end of the period T.

FIG. 2c shows the variation with time of the current i1 through the transistor, which can be detected by means of the current/voltage transformer 3.

Figure 3:
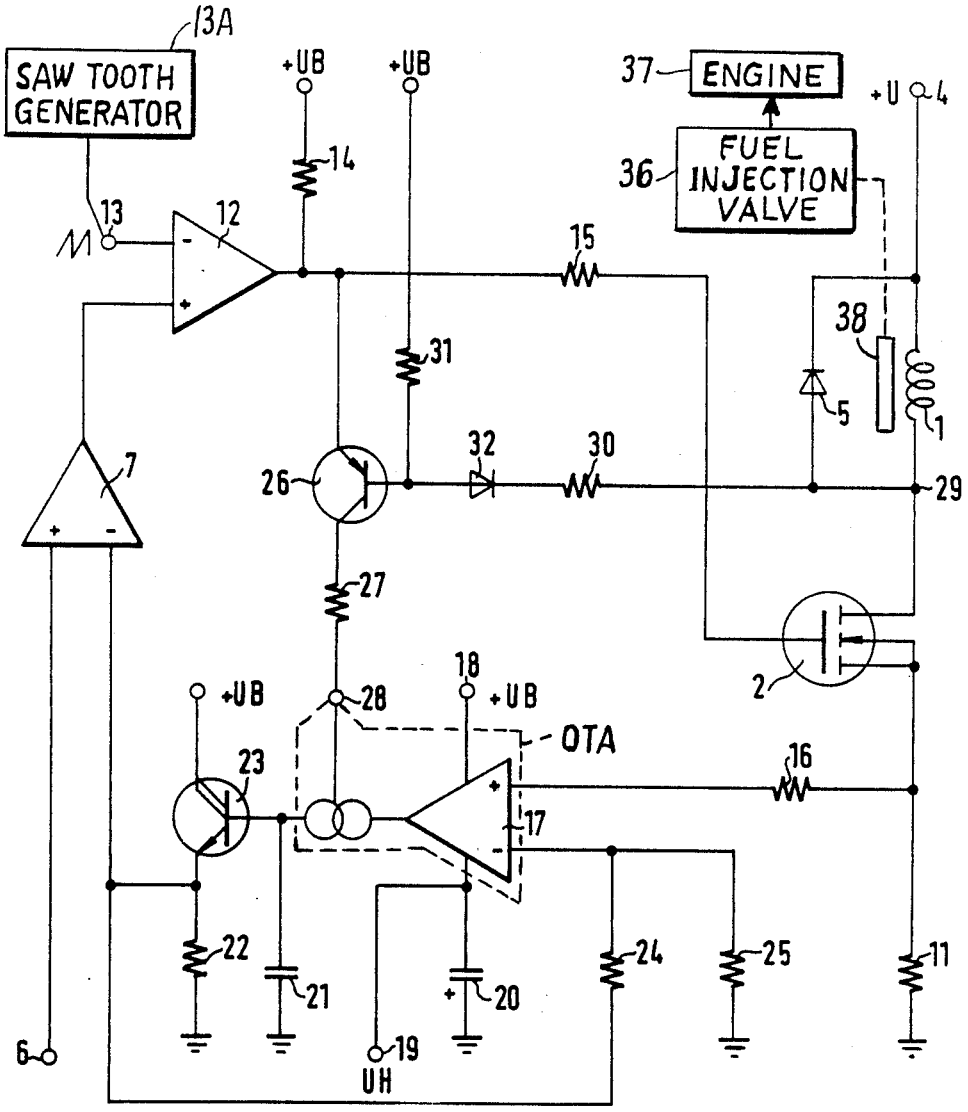
FIG. 3 is a circuit diagram of a second embodiment.

The circuit of FIG. 3 also comprises a coil 1 and a free-running diode 5 which are connected to the positive terminal 4 of a source of operating voltage. In series therewith there is also connected a transistor 2 which is connected to ground potential via a current-measurement resistor 11. Furthermore, there is also provided a controller 7, to which the voltage Usoll (U desired) is fed via an input 6. The pulse-width modulator is formed in the circuit of FIG. 3 by a difference amplifier 12 to one input 13 of which a sawtooth signal, provided by a signal generator 13A, is fed while the output voltage of the controller 7 is fed to the other input of the amplifier 12. The output of the difference amplifier 12 is connected via a resistor 14 to source of voltage +UB and via another resistor 15 to the control electrode of the transistor 2. As customary in such circuits, the voltage UB is stabilized and amounts, for instance, to +5 V.

The voltage drop over the resistor 11, which is proportional to the current, is fed via a resistor 16 to the non-inverting input of a switchable operational amplifier (OTA=operational transductance amplifier) 17 which receives as operating voltage, on the one hand, the positive voltage UB via a terminal 18 and, on the other hand, a negative auxiliary voltage UH from a further source of voltage, filtered by a capacitor 20, of, for instance, −3 V via a terminal 19. To the output of the OTA 17 there is connected an integration capacitor 21 and a transistor 23 which is connected, together with a resistor 22, as emitter follower. From the emitter of the transistor 23, the output voltage of the integrator is fed back, via a voltage divider of resistors 24, 25, to the inverting input of the OTA 17. Furthermore, the output voltage of the integrator passes to the inverting input of the controller 7.

The controlling of the OTA 17 is effected via a transistor 26 the emitter of which is connected to the output of the difference amplifier 12 and the collector of which is connected, via a resistor 27, to the control input 28 of the OTA 17. The controlling of the transistor 26, in its turn, is effected in the manner that the voltage at the junction point 29 between the coil 1 and the transistor 2 is fed, via a voltage divider of resistors 30, 31, to the base of the transistor 26. Furthermore there is provided a diode 32, in series with resistor 30, which protects the base of the transistor 26 from overvoltages.

The controlling of the OTA 17 provides that the OTA 17 supplies an output current only when the transistor 2, and thus also the transistor 26, are conductive. During this time the integrator is active. During the remaining part of the period of the output signals of the pulse-width modulator, the output of the OTA 17 is blocked so that the output voltage of the integrator does not change.

Also shown in FIG. 3 is an example in the use of the circuit for operating a fuel-injection valve 36 for injection of fuel into an engine 37, such as an automobile engine. The injection valve 36 includes a movable magnetic core 38 which is displaced by a magnetic field of the coil 1, the magnetic field being produced by current flowing in the coil 1. In this example, the movable magnetic core 38 and the coil 1 form a solenoid for operation of the valve 36.

We claim:

1. A regulating circuit for regulating a pulsating current in an inductor, in particular the coil of an electromagnetic valve, the circuit comprising the inductor and a diode connected in parallel combination a semiconductor switch connected in series with the parallel combination of diode and inductor, the diode serving as a free-running diode;

a pulse-width modulator, and a controller having an output connected by the modulator to a control input of the switch, there being a desired-value voltage to be fed to the controller;

a current-voltage transformer; and wherein an actual-value voltage drop proportional to the current measurable during a state of conduction in the semiconductor switch is derivable by means of the current voltage transformer, the transformer being connected in series with the inductor and the semiconductor switch; and wherein the circuit further comprises another switch and an integrator, said another switch being controlled by the pulse width modulator for performing a gating of the voltage drop proportional to the current measure as to time, and the integrator connecting to said another switch for performing the integration of the voltage drop proportional to the current measure.

2. A regulating circuit according to claim 1, wherein an output of the current/voltage transformer is connected, via said another switch to an input of the integrator.

3. A regulating circuit according to claim 1, wherein the second switch and the integrator are formed of an amplifier circuit comprising a switchable operational amplifier, a capacitor, a transistor serving as an impedance transformer, and voltage divider, the output of the operational amplifier being connected, via the capacitor and the transistor and the voltage divider, to an inverting input of the amplifier circuit, a non-inverting input of the amplifying circuit being connected to the output voltage of the current/voltage transformer.

4. A regulating circuit according to claim 1, wherein a time constant of the integrator is substantially greater than a period of a signal given off by the pulse-width modulator.

* * * * *